US011754285B2

(12) United States Patent
Kamoi et al.

(10) Patent No.: US 11,754,285 B2
(45) Date of Patent: Sep. 12, 2023

(54) COMBUSTOR FOR GAS TURBINE ENGINE INCLUDING PLURALITY OF PROJECTIONS EXTENDING TOWARD A COMPRESSED AIR CHAMBER

(71) Applicant: HONDA MOTOR CO., LTD., Tokyo (JP)

(72) Inventors: Yasuharu Kamoi, Saitama (JP); Shinichi Kobayashi, Saitama (JP); Hideaki Nakano, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/689,307

(22) Filed: Mar. 8, 2022

(65) Prior Publication Data

US 2022/0307693 A1 Sep. 29, 2022

(30) Foreign Application Priority Data

Mar. 26, 2021 (JP) ..... 2021-053778

(51) Int. Cl.
*F23R 3/06* (2006.01)
*F23R 3/00* (2006.01)

(52) U.S. Cl.
CPC ..... *F23R 3/002* (2013.01); *F23R 3/06* (2013.01); *F23R 2900/03042* (2013.01)

(58) Field of Classification Search
CPC ..... F23R 2900/03042; F23R 3/002; F23R 2900/03041; F23R 2900/03043; F23R 3/06; F23R 3/005
See application file for complete search history.

(56) References Cited

U.S. PATENT DOCUMENTS 2,785,878 A * 3/1957 Conrad ..... F01D 25/08 165/47
2,871,546 A * 2/1959 Conrad ..... F23R 3/08 228/15.1
3,845,620 A * 11/1974 Kenworthy ..... F23R 3/08 431/352
4,259,842 A * 4/1981 Koshoffer ..... F23R 3/08 60/757

(Continued)

FOREIGN PATENT DOCUMENTS

JP 2002206744 A 7/2002
JP 2018017497 A 2/2018

*Primary Examiner* — Thomas P Burke
(74) *Attorney, Agent, or Firm* — Armstrong Teasdale LLP

(57) ABSTRACT

The liner of a combustor (100) for a gas turbine engine is provided with a projection region (111) provided with a plurality of projections (110) each projecting toward the compressed air chamber (56) from the liner outer surface and having a vertical wall portion (114) extending substantially orthogonally to a flow direction of compressed air flowing in the compressed air chamber, and a plurality of cooling holes (118) passed through the liner from the liner outer surface to the liner inner surface such that an end of each cooling hole on a side of the compressed air chamber is more downstream than an end of the cooling hole on a side of the combustion chamber (52) with respect to the flow direction of the compressed air in the compressed air chamber, at least a part of the cooling holes being formed in the projection region.

8 Claims, 10 Drawing Sheets

(56) References Cited

U.S. PATENT DOCUMENTS

| | | | | |
|---|---|---|---|---|
| 4,380,906 | A * | 4/1983 | Dierberger | F23R 3/08 60/757 |
| 4,723,413 | A * | 2/1988 | Simon | F23R 3/08 60/757 |
| 5,329,773 | A * | 7/1994 | Myers | F23R 3/08 60/757 |
| 6,079,199 | A * | 6/2000 | McCaldon | F23R 3/54 60/757 |
| 2013/0074507 | A1* | 3/2013 | Kaleeswaran | F23R 3/06 60/754 |
| 2015/0121885 | A1* | 5/2015 | Yokota | F23R 3/005 60/757 |
| 2018/0031237 | A1 | 2/2018 | Kamoi et al. | |

* cited by examiner

COMBUSTOR FOR GAS TURBINE ENGINE INCLUDING PLURALITY OF PROJECTIONS EXTENDING TOWARD A COMPRESSED AIR CHAMBER

TECHNICAL FIELD

The present invention relates to a combustor for a gas turbine engine, and more particularly to a cooling structure of a combustor for a gas turbine engine.

BACKGROUND ART

The liner of the combustor for a gas turbine engine becomes extremely hot when the gas turbine engine is in use by coming into contact with high temperature combustion gas. Therefore, various cooling measures are taken to prevent damage to the liner due to the high temperature. The previously proposed measures for cooling the liner include a technology based on convection cooling using compressed air flowing in the surrounding compressed air chamber and a technology based on film cooling of the inner surface of the liner by conducting compressed air into the combustion chamber via cooling holes formed in the liner.

JP2002-206744A discloses a combustor for a gas turbine engine having a liner provided with projections protruding from the outer surface thereof toward the compressed air chamber. According to this configuration, the projections obstruct the flow of the compressed air flowing through the compressed air chamber so that a turbulent flow of compressed air is generated around the projections. This causes convection of compressed air at a relatively low temperature causing the liner at a relatively high temperature to be cooled.

JP2018-017497A discloses a combustor for a gas turbine engine having a liner provided with through holes extending at an angle so that the compressed at a relatively high pressure flows into the combustion chamber at a relatively low pressure via the through holes to form a film of air on the inner surface of the liner. This film of air serves as a heat insulating layer.

However, the structures disclosed in JP2002-206744A and JP2018-017497A are not able to provide an adequately high cooling performance.

In view of such a problem of the prior art, a primary object of the present invention is to provide a combustor for a gas turbine engine having a structure capable of providing a high cooling performance.

To achieve such an object, one aspect of the present invention provides a combustor (100) configured to be placed in a compressed air chamber (56) of a gas turbine engine (10) and formed around an axial line to define a combustion chamber (52) for generating combusted gas therein, the combustor including a liner (102) having a liner outer surface (107) facing the compressed air chamber and a liner inner surface (106) facing the combustion chamber, wherein the liner is provided with a projection region (111) provided with a plurality of projections (110) each projecting toward the compressed air chamber from the liner outer surface and having a vertical wall portion (114) extending substantially orthogonally to a flow direction of compressed air flowing in the compressed air chamber, and a plurality of cooling holes (118) passed through the liner from the liner outer surface to the liner inner surface such that an end of each cooling hole on a side of the compressed air chamber is more downstream than an end of the cooling hole on a side of the combustion chamber with respect to the flow direction of the compressed air in the compressed air chamber, at least a part of the cooling holes being formed in the projection region.

Since the vertical wall portion of each projection faces the flow direction of the compressed air, the turbulent flow of the compressed air is promoted on the outer surface of the liner so that the heat transfer from the outer surface of the liner is promoted owing to the convection of the compressed air. Further, since a heat shielding layer is formed on the inner surface of the liner by the flow of the compressed air introduced into the combustion chamber through the cooling holes, the heat transfer from the combustion gas at a high temperature to the liner can be reduced. In particular, since at least a part of the cooling holes are provided in the projection region, the compressed air is decelerated in the flow direction thereof around the projections so that the compressed air is more actively introduced into the cooling holes. As a result, the combustor for the gas turbine can be favorably cooled.

Preferably, in this configuration, each projection is provided with a parallel wall portion (115) extending from the vertical wall portion in a downstream direction with respect to the air flow of the compressed air in parallel with an outer surface of the liner, and an inclined wall portion (116) extending from a downstream end of the parallel wall portion to the outer surface of the liner in an inclined direction with respect to the flow direction of the compressed air.

Thereby, turbulent flow of the compressed air is promoted on the outer surface of the liner so that the heat transfer from the outer surface of the liner by the convection of the compressed air is improved, and the flow rate of the compressed air introduced into the combustion chamber via the cooling holes is stabilized.

Preferably, in this configuration, each projection is formed as a ridge extending in a direction substantially orthogonal to the flow direction of the compressed air.

Thereby, the turbulence of the compressed air flow on the outer surface of the liner is promoted so that the heat transfer from the outer surface of the liner owing to the convection is improved, the velocity distribution of the compressed air flow on the outer surface of the liner can be made comparatively uniform, and the flow rate of the compressed air introduced into the combustion chamber via the cooling holes is stabilized.

Preferably, in this configuration, the end of each cooling hole on the side of the compressed air chamber opens at the parallel wall portion or at the inclined wall portion.

Thereby, the length of each cooling hole in the axial direction can be increased so that the surface area of the inner surface of the cooling hole is maximized. As a result, the amount of heat transferred from the inner surface of the cooling hole to the compressed air flowing through the cooling hole increases so that the combustor for the gas turbine can be favorably cooled. In particular, if the end of the cooling hole on the side of the compressed air chamber is located on the inclined wall portion, the drilling work for the cooling hole can be facilitated.

Preferably, in this configuration, each cooling hole extends in a direction substantially perpendicular to a surface of the inclined wall portion.

Thereby, drilling of the cooling hole is particularly facilitated.

Preferably, in this configuration, each cooling hole opens at a part of the liner where the projections are absent.

Thereby, drilling of the cooling hole is particularly facilitated.

Preferably, in this configuration, a cross-sectional area of each cooling hole progressively increases toward the side of the combustion chamber.

Thereby, the speed of the compressed air is decreased toward the end of the cooling hole on the side of the combustion chamber side so that a heat shielding film is particularly favorably formed on the inner surface of the liner, and the combustor for the gas turbine can be favorably cooled.

Preferably, in this configuration, each cooling hole is formed so that an extension line thereof does not interfere with the projection adjacent on the downstream side of the flow direction of the compressed air.

Thereby, drilling of the cooling holes is facilitated.

Preferably, in this configuration, at least one of the projections is provided with a notch (121) corresponding to an extension line of the cooling hole immediately upstream of the at least one projection with respect to the flow direction of the compressed air.

Thereby, the compressed air can flow into the cooling holes in a smooth manner, and the cooling holes and the notches can be formed by using a single machining process using a cutting tool such as a drill so that the manufacturing process can be simplified.

Preferably, in this configuration, the cooling holes are arranged so as to align in a circumferential direction of the liner.

Thereby, drilling of the cooling holes can be facilitated.

Preferably, in this configuration, the cooling holes are arranged so as to correspond to the projections.

Thereby, drilling of the cooling holes can be facilitated.

Thus, the present invention provides a combustor for a gas turbine engine having a structure capable of providing a high cooling performance.

MODIFICATION OF THE PRESENT INVENTION

Description of the Preferred Embodiment(s)

Figure 1:
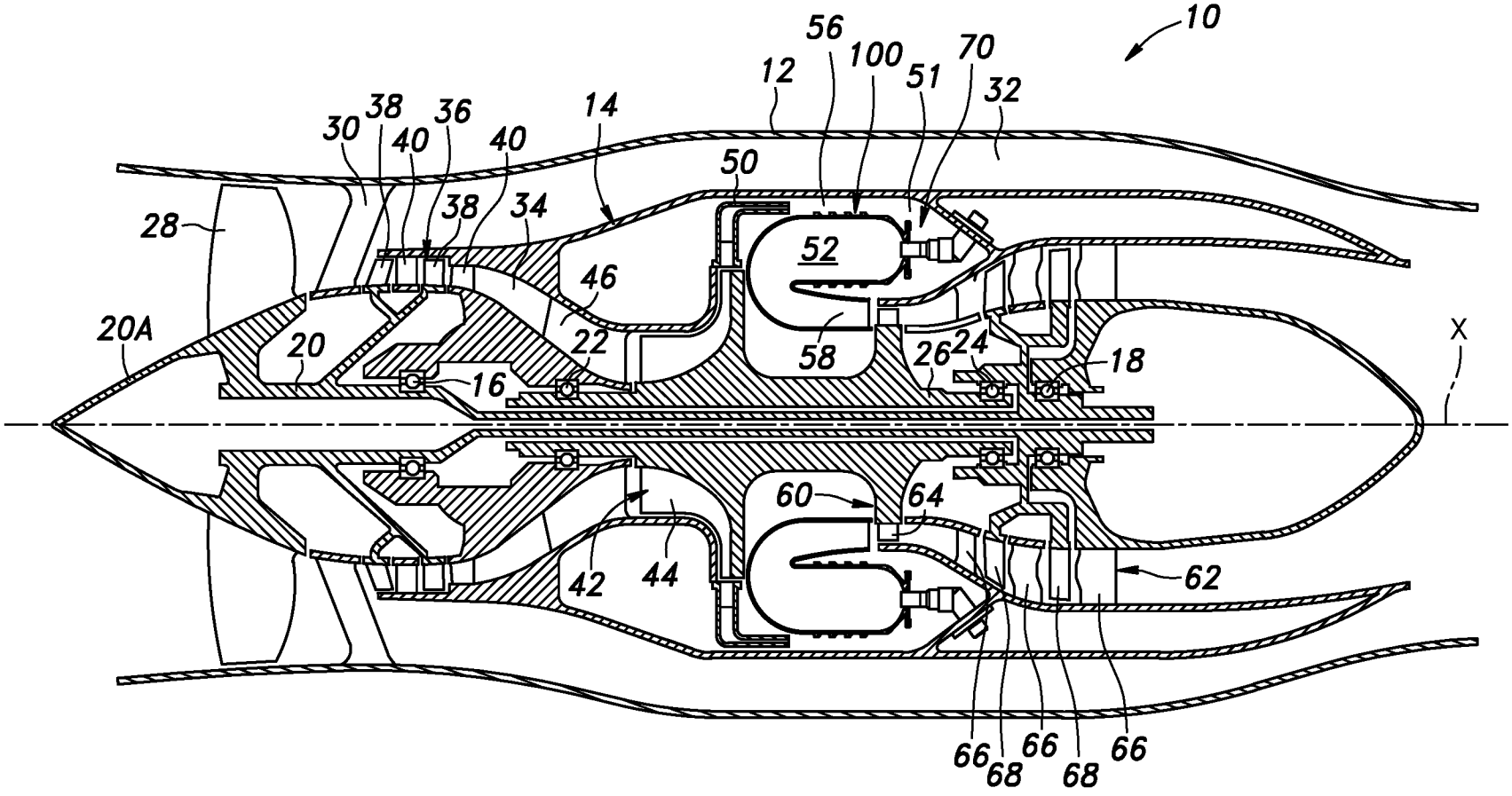
FIG. 1 is a sectional view of a gas turbine engine provided with a combustor according to an embodiment of the present invention.

An embodiment of the present invention in the form of a combustor 100 for a gas turbine engine 10 for aircraft will be described with reference to the drawings. First, an outline of the gas turbine engine 10 in which the gas turbine combustor 100 of the present embodiment is used will be described in the following with reference to FIG. 1.

The gas turbine engine 10 has an outer casing 12 and an inner casing 14 both cylindrical in shape and disposed coaxially to each other about a common central axis X. A low-pressure rotary shaft 20 is rotatably supported by the inner casing 14 via a front first bearing 16 and a rear first bearing 18. A high-pressure rotary shaft 26 consisting of a hollow shaft coaxially surrounds the low-pressure rotary shaft 20 about the common central axis X, and is rotatably supported by the inner casing 14 and the low-pressure rotary shaft 20 via a front second bearing 22 and a rear second bearing 24, respectively.

The low-pressure rotary shaft 20 includes a substantially conical tip portion 20A protruding forward from the inner casing 14. A front fan 28 including a plurality of front fan blades is provided on the outer periphery of the tip portion 20A along the circumferential direction. A plurality of stator vanes 30 are arranged on the outer casing 12 on the downstream side of the front fan 28 at regular intervals along the circumferential direction. Downstream of the stator vanes 30, a bypass duct 32 having an annular cross-sectional shape is defined between the outer casing 12 and the inner casing 14 coaxially with the central axis X. An air compression duct 34 having an annular cross-sectional shape is defined centrally in the inner casing 14.

An axial-flow compressor 36 is provided at the inlet end of the air compression duct 34. The axial-flow compressor 36 includes a pair of rotor blade rows 38 provided on the outer periphery of the low-pressure rotary shaft 20 and a pair of stator vane rows 40 provided on the inner casing 14 in an alternating relationship in the axial direction.

An outlet of the air compression duct 34 is provided with a centrifugal compressor 42 which includes an impeller 44 fitted on the outer periphery of the high-pressure rotary shaft 26. At the outlet end of the air compression duct 34 or the upstream end of the impeller 44, a plurality of struts 46 extend radially in the inner casing 14 across the air compression duct 34. A diffuser 50 is provided at the outlet of the centrifugal compressor 42, and is fixed to the inner casing 14.

The downstream end of the diffuser 50 is provided with a combustor 100 for combusting the fuel therein. The combustor 100 includes an annular combustion chamber 52 centered around the central axis X. The compressed air supplied by the diffuser 50 is forwarded to the combustion chamber 52 via a compressed air chamber 51 defined between the outlet end of the diffuser 50 and the combustion chamber 52.

A plurality of fuel injection nozzles 70 for injecting liquid fuel into the combustion chamber 52 are attached to the inner casing 14 at regular intervals along the circumferential direction around the central axis X. Each fuel injection nozzle 70 injects liquid fuel into the combustion chamber 52. In the combustion chamber 52, high-temperature combustion gas is generated by combustion of a mixture of the liquid fuel injected from the liquid fuel injection nozzle 70 and the compressed air supplied from the compressed air chamber 51.

A high-pressure turbine 60 and a low-pressure turbine 62 are provided on the downstream side of the combustion chamber 52. The high-pressure turbine 60 includes a stator vane row 58 fixed to the outlet end of the combustion chamber 52 which is directed rearward, and a rotor blade row 64 fixed to the outer periphery of the high-pressure rotary shaft 26 on the downstream side of the rotor blade row 64. The low-pressure turbine 62 is located on the downstream side of the high-pressure turbine 60, and includes a plurality of stator vane rows 66 fixed to the inner casing 14 and a plurality of rotor blade rows 68 provided on the outer periphery of the low-pressure rotary shaft 20 so as to alternate with the stator vane rows 66 along the axial direction.

When the gas turbine engine 10 is started, the high-pressure rotary shaft 26 is rotationally driven by a starter motor (not shown). When the high-pressure rotary shaft 26 is rotationally driven, compressed air compressed by the centrifugal compressor 42 is supplied to the combustion chamber 52, and the air-liquid fuel mixture burns in the combustion chamber 52 to generate combustion gas. The combustion gas is impinged upon the blades of the rotor blade rows 64 and 68 to rotate the high-pressure rotary shaft 26 and the low-pressure rotary shaft 20. As a result, the front fan 28 rotates, and the axial-flow compressor 36 and the centrifugal compressor 42 are operated, so that compressed air is supplied to the combustion chamber 52, and the gas turbine engine 10 continues to operate even after the starter motor is disengaged.

Further, a part of the air drawn by the front fan 28 during the operation of the gas turbine engine 10 passes through the bypass duct 32 and is ejected to the rear to generate additional thrust. The rest of the air drawn by the front fan 28 is supplied to the combustion chamber 52, and forms a part of fuel mixture jointly with the liquid fuel. The combustion gas generated by the combustion of the mixture drives the low-pressure rotary shaft 20 and the high-pressure rotary shaft 26, and then is ejected rearward to generate a large part of the thrust provided by this gas turbine engine 10.

Figure 2:
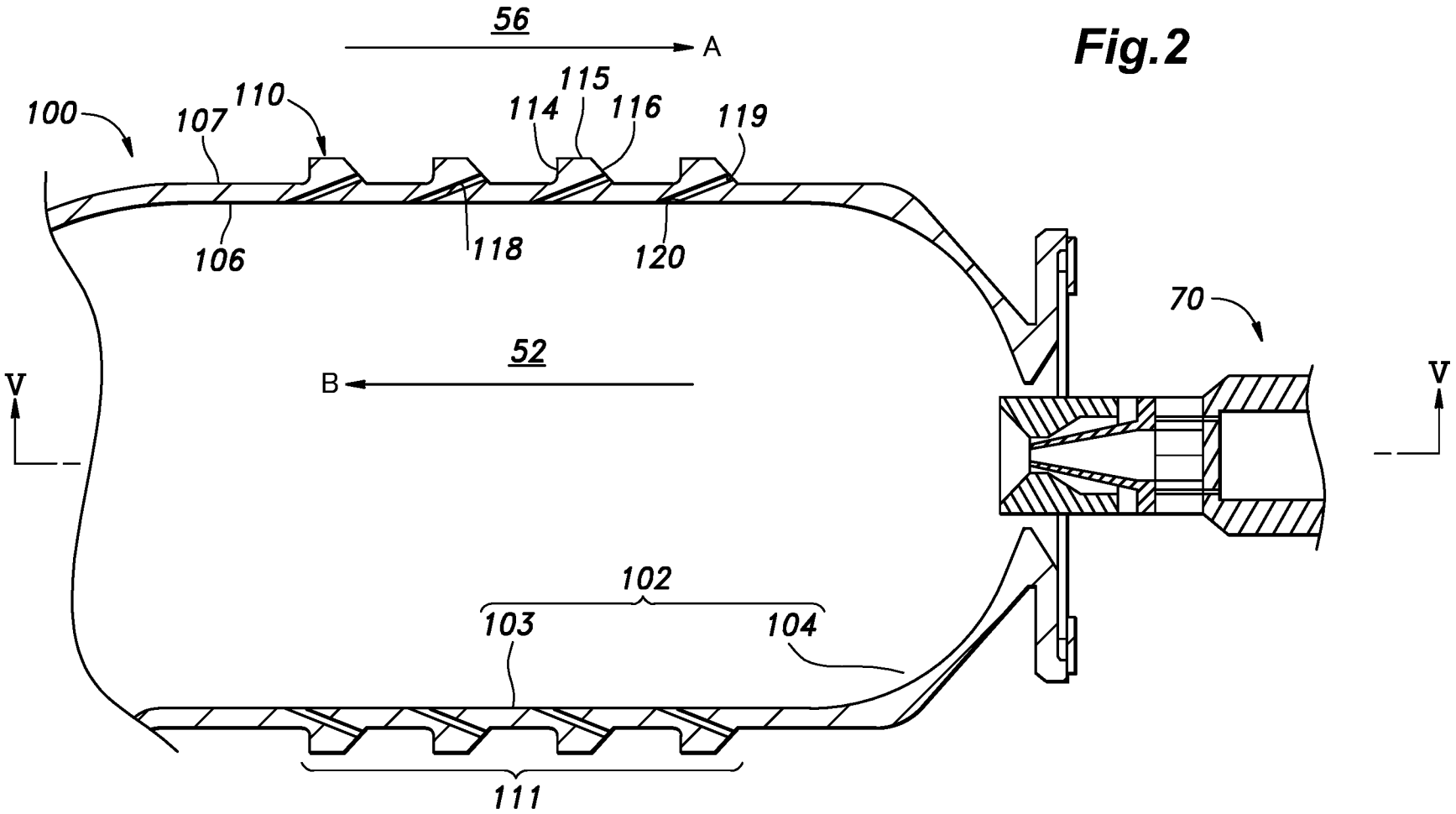
FIG. 2 is a sectional view of the combustor.

The details of the combustor 100 for a gas turbine engine according to the present embodiment will be described in the following. FIG. 2 shows in detail the combustor 100 for a gas turbine engine. The illustrated combustor 100 for a gas turbine engine is a reverse flow type combustor, and the front side of the combustor 100 corresponds to the upstream side of the flow direction A of the compressed air and the downstream side of the flow direction B of the combustion gas. As another embodiment, the combustor 100 for a gas turbine may be a straight through type combustor.

The combustor 100 includes an annular liner 102 coaxial with the central axis X of the gas turbine engine 10. The liner 102 includes an annular main body 103 including a side wall substantially parallel to the axial direction, and a dome portion 104 connected to the rear end of the main body 103 and whose diameter gradually decreases rearward. A combustion chamber 52 is defined by a liner inner surface 106, which is a surface of the liner 102 facing the combustion chamber 52, and a liner outer surface 107, which is a surface of the liner 102 facing the compressed air chamber 56. The front end of the liner 102, or more specifically, the front end of the main body 103, is connected to the inlet of the high-pressure turbine 60 via a tapering duct portion. The illustrated combustor 100 for a gas turbine engine is an annular type combustor, but may also be a can type combustor.

Figure 3:
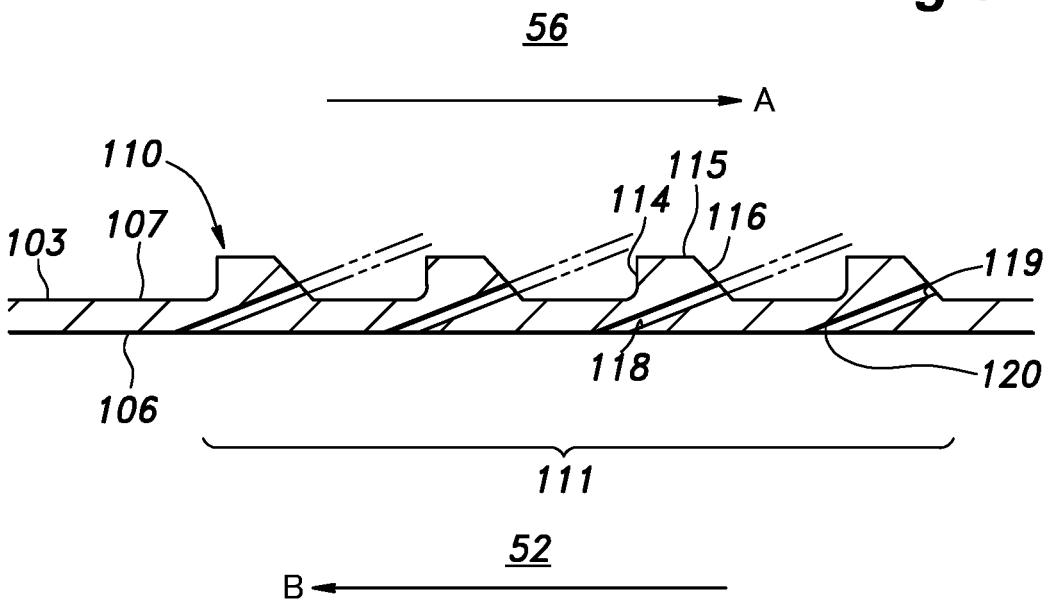
FIG. 3 is an enlarged fragmentary sectional view of the combustor.

As shown in FIGS. 2 and 3, the main body 103 of the liner 102 is provided with a plurality of projections in the form of ridges 110 that protrude from the liner outer surface 107 toward the compressed air chamber 56. A region where the ridges 110 are populated is referred to as a projection region 111. The projection region 111 is a band-shaped region provided along the axial direction of the main body 103 over a predetermined range, and extending over the entire circumference of the outer surface 107 of the liner 102. The projection region 111 may be provided on the main body 103 and the dome portion 104, or may be provided only on the main body 103.

The flow direction A of the compressed air flowing in the compressed air chamber 56 is substantially parallel to the axial direction while the ridges 110 extend in the circumferential direction. Therefore, the ridges 110 extend in a direction substantially orthogonal to the flow direction A of the compressed air or on a plane substantially orthogonal to the flow direction A of the compressed air. In other words, the ridges 110 consist of a plurality of annular ridges provided at predetermined intervals in the axial direction.

Each ridge 110 includes a vertical wall portion 114 that opposes the compressed air flow direction A in a substantially orthogonal relationship, a parallel wall portion 115 extending from the upper end of the vertical wall portion 114 toward the downstream side of the compressed air flow direction A substantially parallel to the liner outer surface 107, and an inclined wall portion 116 extending from the downstream end of the parallel wall portion 115 to the liner outer surface 107 at an angle. In this embodiment, the vertical wall portion 114 extends in a direction orthogonal to the central axis X. The inclined wall portion 116 is inclined from the rear end of the parallel wall portion 115 toward the liner outer surface 107 (along the axial direction) so as to come closer to the liner outer surface 107 as one moves in the flow direction A of the compressed air.

A plurality of cooling holes 118 are passed through the liner 102 so as to extend from the liner inner surface 106 to the liner outer surface 107. The cooling holes 118 are inclined toward the downstream side of flow direction B of the combustion gas as one moves from the liner outer surface 107 to the liner inner surface 106 (inclined toward the downstream side of the flow direction A of the compressed air as one moves from the liner inner surface 106 to the liner outer surface 107). The cooling holes 118 extend in the axial direction in side view (as seen from a radial direction). Each cooling hole 118 consists of a straight drilled hole that opens at the surface of the inclined wall portion 116 and extends in a direction orthogonal to the surface of the inclined wall portion 116. The inclination angle of the cooling hole 118 is preferably 45 degrees or more, and more preferably 60 degrees or more with respect to the normal direction of the liner outer surface 107.

In a gas turbine engine, since the pressure inside the compressed air chamber 56 is usually higher than that inside the combustion chamber 52, a part of the compressed air flowing in the compressed air chamber 56 flows into the combustion chamber 52 through the cooling holes 118. Therefore, the end of each cooling hole 118 on the side of the compressed air chamber 56 may be referred to as an inlet 119, and the end of the cooling hole 118 on side of the combustion chamber 52 may be referred to as an outlet 120. In the present embodiment, each cooling hole 118 is formed as a cylindrical hole having a constant diameter, but the diameter of the cooling hole 118 may vary along the length thereof.

The fluid dynamic actions of the ridges 110 and the cooling holes 118 of the present embodiment will be described. First, the compressed air flowing in the compressed air chamber 56 in the flow direction A substantially parallel to the axial direction collides with the vertical wall portion 114 of the ridges 110 in the projection region 111. As a result, the flow of the compressed air in the flow direction A is obstructed, and the turbulent flow of the compressed air is promoted on the downstream side of each ridge 110 with respect to the flow direction A of the compressed air. As a result, the heat transfer from the liner outer surface 107 is improved owing to the convection of the compressed air so that the projection region 111 of the liner 102 of the combustor 100 provided with the ridges 110 is favorably cooled. Further, since the pressure inside the compressed air chamber 56 is higher than that inside the combustion chamber 52, a part of the compressed air is guided into the cooling holes 118 through the inlets 119 thereof opened in the inclined wall portions 116. Thus, in the present embodiment, the cooling holes 118 are arranged in the projection region 111 so that the flow of compressed air introduced into the combustion chamber 52 through the cooling hole 118 is promoted.

The compressed air introduced into the outlet 120 of each cooling hole 118 is expelled into the combustion chamber 52. Since the cooling hole 118 is inclined from the liner outer surface 107 to the liner inner surface 106 toward the downstream side with respect to the flow direction B of the combustion gas, the compressed air is blown out in a substantially same direction as the flow direction B of the combustion gas, and the radial component of the flow velocity of the compressed air flowing into the combustion chamber 52 is relatively small. As a result, the compressed air flows along the liner inner surface 106 so that a heat shielding layer is formed on the liner inner surface 106. Since the heat shielding layer can effectively protect the liner inner surface 106 of the high temperature combustion gas, the temperature rise of the liner 102 of the combustor 100 for a gas turbine can be minimized.

In FIGS. 1 to 3, the combustor 100 for a gas turbine engine according to the present invention was shown as an annular combustor. In FIGS. 4 to 10 showing different embodiments, the gas turbine combustor 100 consists of a can type combustor.

Figure 4:
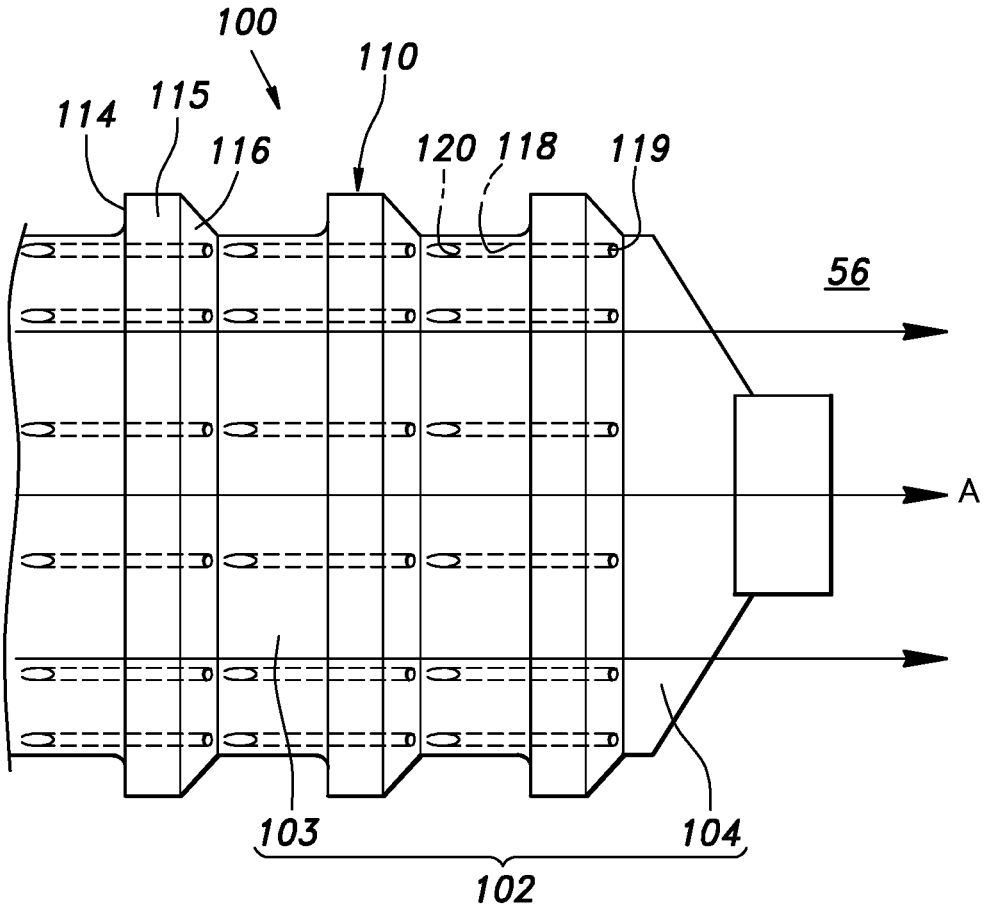
FIG. 4 is a side view of the combustor.
Figure 5:
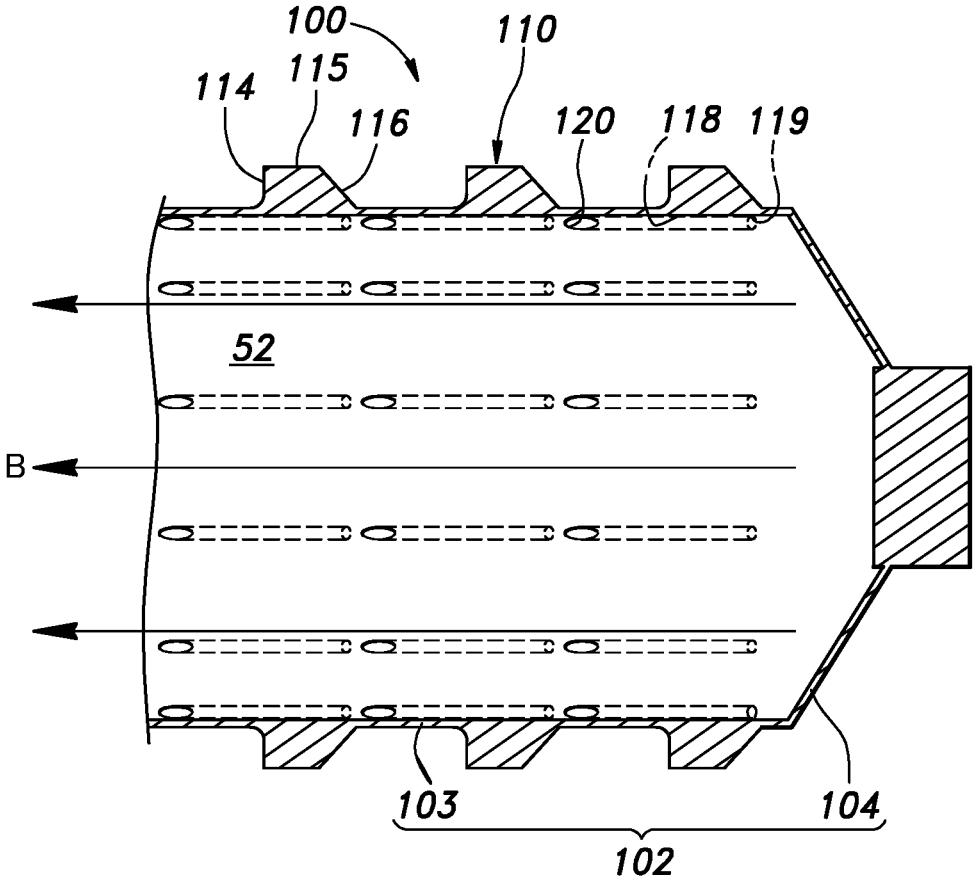
FIG. 5 is a sectional view taken along line V-V of FIG. 2.

In the combustor 100 shown in FIGS. 4 and 5, the cooling holes 118 are provided so as to correspond to the arrangement of the ridges 110, and in particular, are arranged at regular intervals in the circumferential direction. Further, the cooling holes 118 are positioned in the projection region 111. If desired, some of the cooling holes 118 may be arranged inside the projection region 111 while the rest of the cooling holes 118 are arranged outside the projection region 111.

Figure 6:
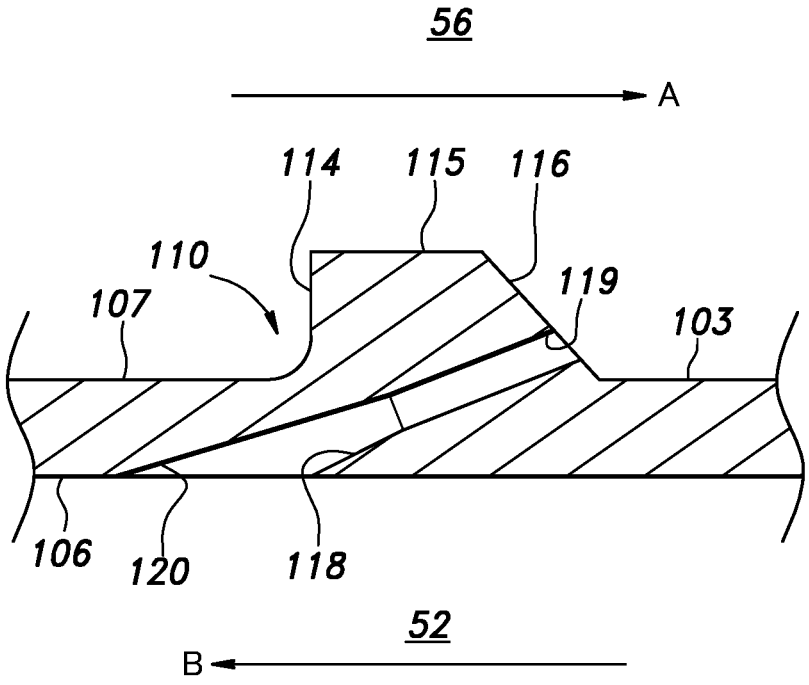
FIG. 6 is an enlarged sectional view of a combustor according to a first modified embodiment of the present invention.

FIG. 6 shows a modified embodiment in which each cooling hole 118 includes a section having a constant diameter on the side of the inlet 119 and a tapering section on the side of the outlet 120. In the tapering section, the diameter of the cooling hole 118 gradually increases towards the outlet 120. As a result, the compressed air flowing in the cooling hole 118 is decelerated toward the outlet 120. Therefore, the compressed air tends to flow along the inner surface 106 of the liner 102 so that the temperature rise of the liner 102 of the combustor 100 for a gas turbine can be further reduced.

Figure 7:
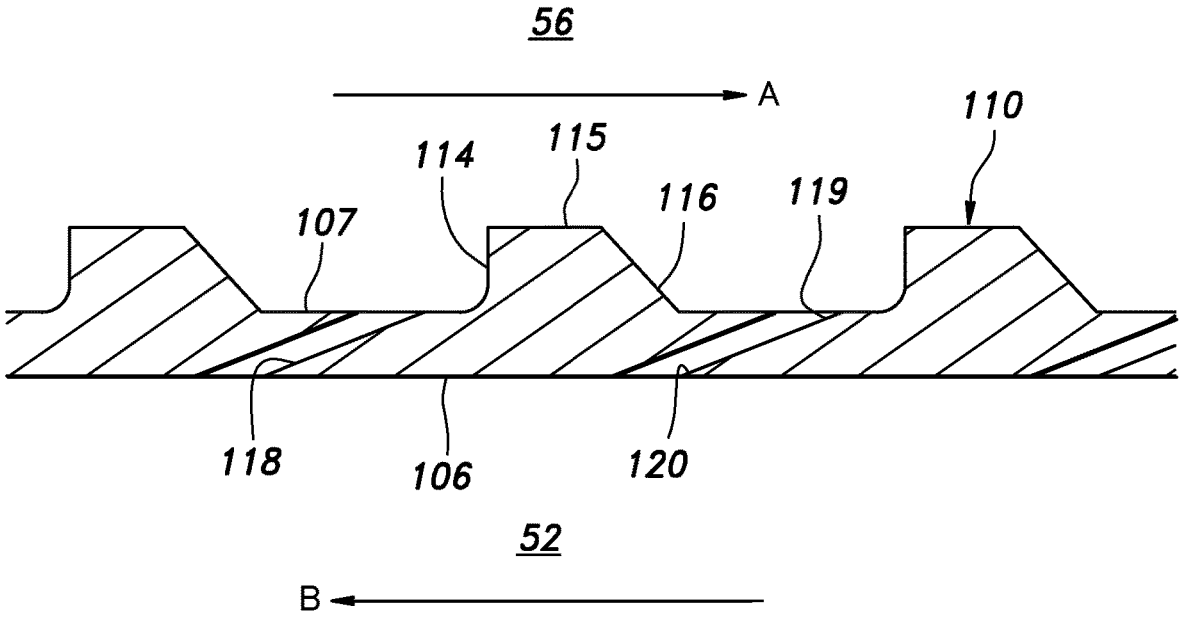
FIG. 7 is an enlarged sectional view of a combustor according to a second modified embodiment of the present invention.
Figure 8:
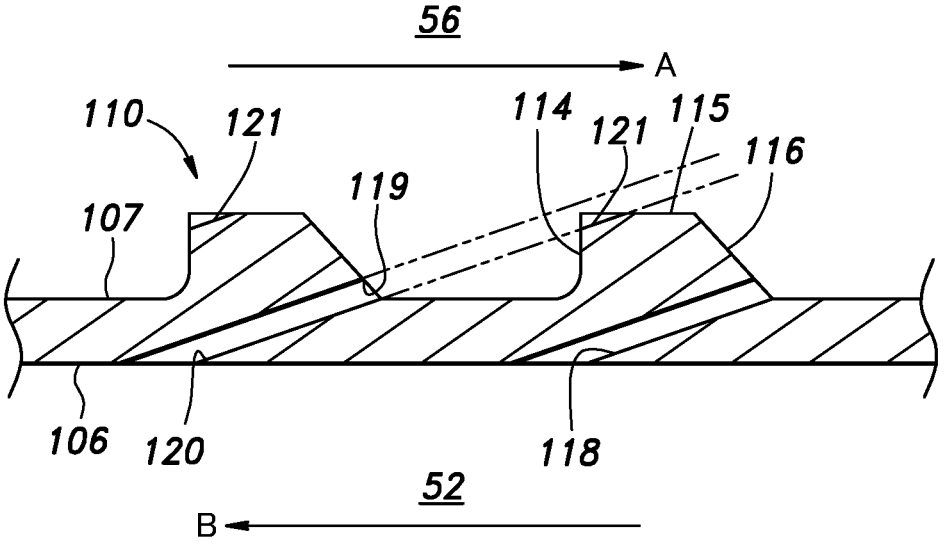
FIG. 8 is an enlarged sectional view of a combustor according to a third modified embodiment of the present invention.

FIG. 7 shows another modified embodiment in which the inlet 119 of each cooling hole 118 opens at a point intermediate between adjoining ridges 110 in the projection region 111. As a result, the cooling holes 118 can be formed in a relatively thin part of the liner 102 so that the drilling or machining the cooling holes 118 can be facilitated. Further, the cooling holes 118 may include those having inlets 119 at the ridge(s) 110 and those having inlets 119 at the portion(s) of the liner 102 located between adjoining ridges 110. Thereby, the number of cooling holes 118 provided in the liner 102 can be increased, and the combustor 100 can be particularly favorably cooled.

Further, depending on the height of the ridges 110 and the distance between the adjoining ridges 110, the drill for forming the cooling hole 118 may interfere with the adjacent ridge 110. Therefore, in the modified embodiment shown in FIG. 8, a part-cylindrical notch 121 corresponding to the extension of the cooling hole 118 is provided in the ridge 110 located immediately next to the inlet 119 of the cooling hole 118 (on the downstream side with respect to the air flow in the compress air chamber 56). The notch 121 also has a function of promoting the formation of a turbulent flow of the compressed air and smoothing the compressed air flowing into the inlet 119 of the corresponding cooling hole 118. In particular, by making each notch 121 in a part-cylindrical shape corresponding to the extension of the cooling hole 118, it is possible to promote the formation of turbulent flow of compressed air and smooth the flow of compressed air, and at the same time facilitate the forming process of the cooling hole 118 using a drill.

Figure 9A:
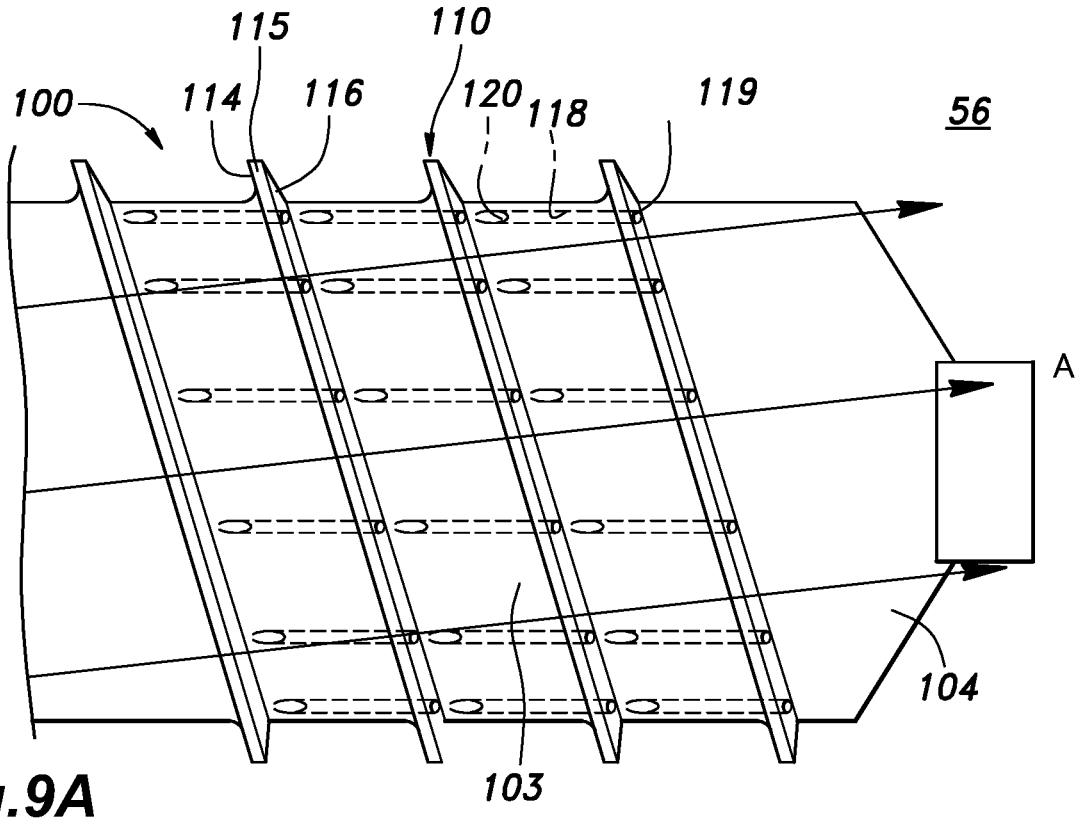
FIG. 9A is a side view of a combustor according to a fourth modified embodiment of the present invention.
Figure 9B:
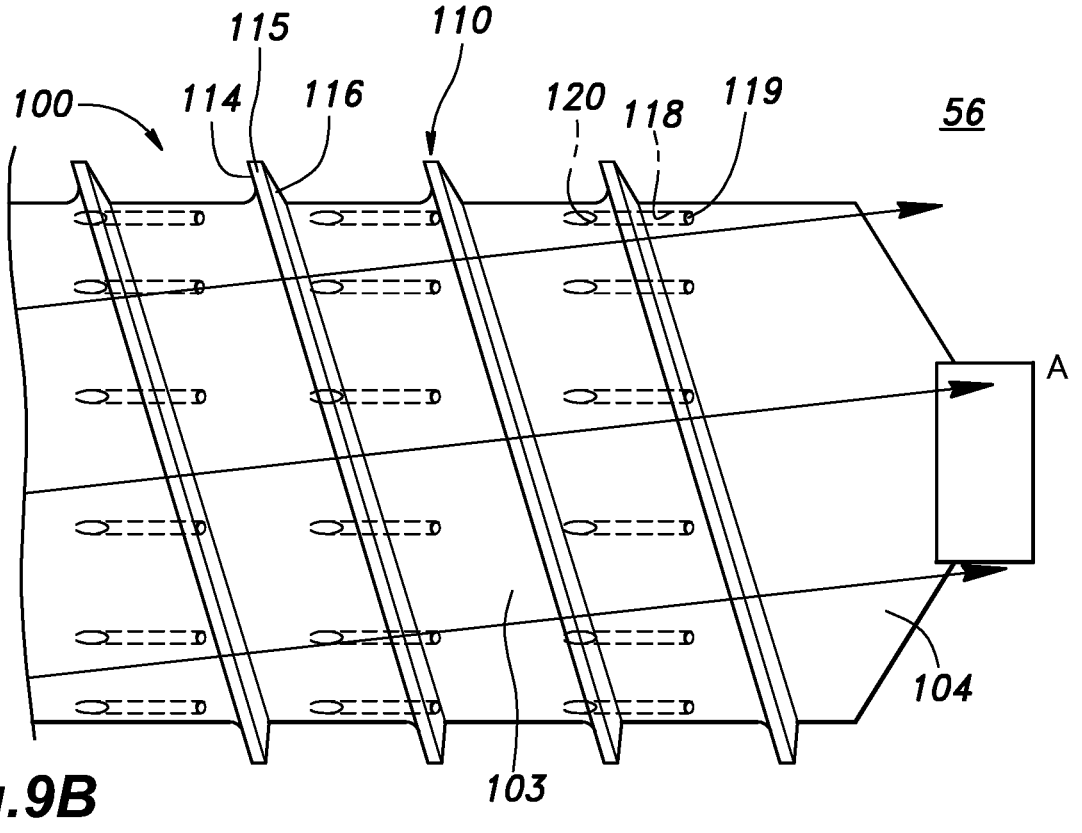
FIG. 9B is a side view of a combustor according to a fifth modified embodiment of the present invention.

FIGS. 9A and 9B show yet other modified embodiments in which each ridge 110 is provided so as to be inclined with respect to the axial direction in the side view. These embodiments are configured to deal with the case where the flow direction A of the compressed air is inclined with respect to the axial direction. Therefore, the vertical wall portion 114 of the ridge 110 is substantially orthogonal to the flow direction A of the compressed air. In this case also, the flow direction A of the compressed air on the side of the inlets 119 of the cooling holes 118 is substantially orthogonal to the extending direction of the ridges 110. Further, in these cases also, the cooling holes 118 are each inclined toward the downstream side with respect to the flow direction B of the combustion gas as one moves from the inlet 119 to the outlet 120 thereof. In the modified embodiment shown in FIG. 9A, the cooling hole 118 has a certain positional relationship with the ridge 110. In particular, the inlets 119 of the cooling holes 118 are positioned in the inclined wall portions 116. Thereby, the functions of the cooling holes 118 can be favorably performed. In the modified embodiment shown in FIG. 9B, the cooling holes 118 are arranged at regular intervals both in the circumferential direction and the axial direction, and therefore, independently from the positions of the ridges 110. In other words, the positional relationships of the cooling holes 118 relative to the ridges 110 vary from one cooling hole 108 to another. In particular, the inlets 119 of some of the cooling holes 118 are located at (the inclined wall portions 116 of) the ridges 110, and the inlets 119 of other cooling holes 118 are located in parts of the liner 102 where no ridge 115 is present. This modified embodiment simplifies the process of forming the cooling holes 118.

Figure 10A:
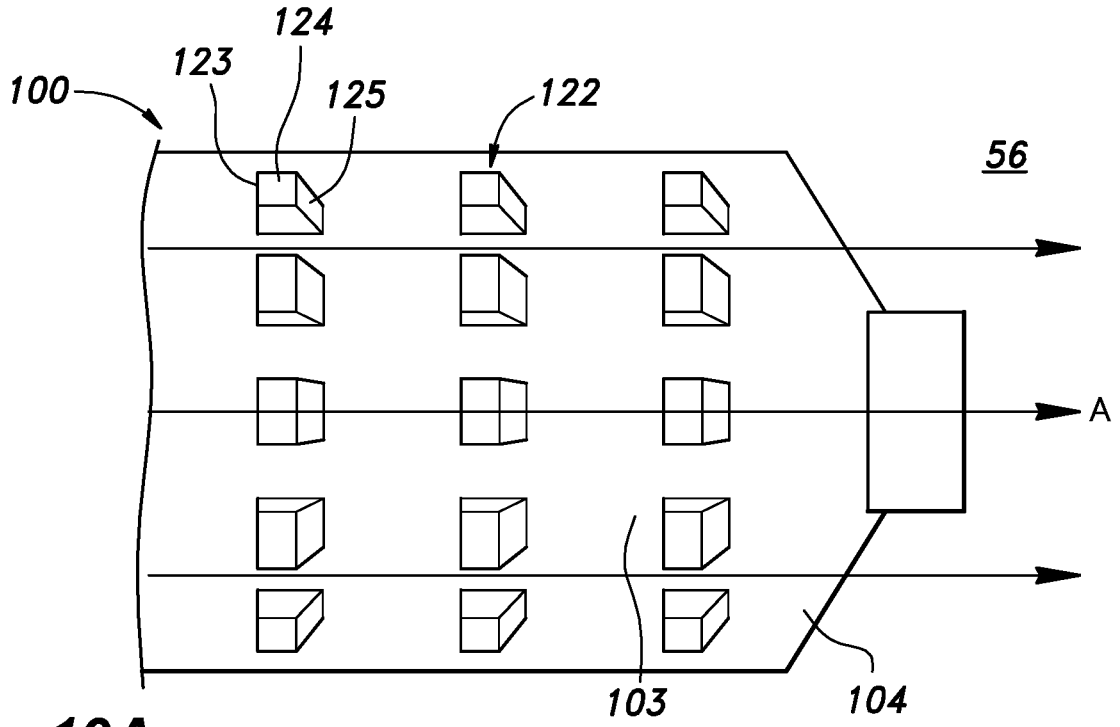
FIG. 10A is a side view of a combustor according to a sixth modified embodiment of the present invention.
Figure 10B:
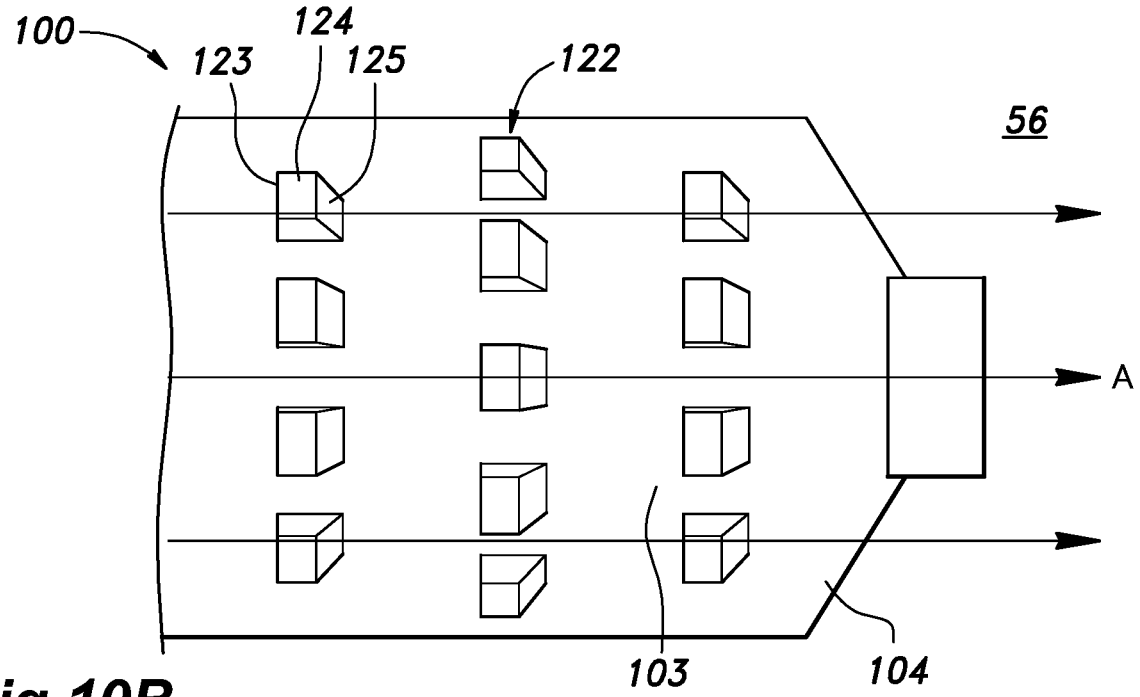
FIG. 10B is a side view of a combustor according to a seventh modified embodiment of the present invention.

In the modified embodiments shown in FIGS. 10A and 10B, in place of the ridges 110, a plurality of isolated or discrete projections 122 are formed on the liner outer surface 107 or the outer periphery of the liner 102. Also in this case, each projection 122 is provided with a vertical wall portion 123 corresponding to the vertical wall portion 114 of the ridge 110, a parallel wall portion 124 corresponding to the parallel wall portion 115, and an inclined wall portion 125 corresponding to the inclined wall portion 116. In this case also, the vertical wall portion 123 opposes the flow direction A of the compressed air, and the inclined wall portion 125 faces away from the flow direction A of the compressed air. Further, the inlet 119 of each cooling hole 118 is provided on the inclined wall portion 125. These projections 122 may form a plurality of rows arranged at equal intervals in the axial direction, and may be arranged at equal intervals in the circumferential direction in each row. In the modified embodiment shown in FIG. 10A, the projections 122 are aligned in the axial direction, but in the modified embodiment shown in FIG. 10B, the projections 122 are arranged in a staggered relationship from one row to another so that the projections 122 in one of the rows are aligned with the gaps between the projections 122 in the adjacent rows.

The present invention has been described in terms of specific embodiments, but are not limited by such embodiments, and can be modified in various ways without departing from the scope of the present invention. For example, laser machining may be used for forming the cooling holes 118 instead of drilling.

The invention claimed is:

1. A combustor configured to be placed in a compressed air chamber of a gas turbine engine and formed around an axial line to define a combustion chamber for generating combusted gas therein, the combustor including a liner having a liner outer surface facing the compressed air chamber and a liner inner surface facing the combustion chamber, wherein the liner is provided with a projection region provided with a plurality of projections each projecting toward the compressed air chamber from the liner outer surface and having a vertical wall portion extending substantially orthogonally to a flow direction of compressed air flowing in the compressed air chamber, and a plurality of cooling holes passed through the liner from the liner outer surface to the liner inner surface such that an end of each cooling hole on a side of the compressed air chamber is more downstream than an end of each cooling hole on a side of the combustion chamber with respect to the flow direction of the compressed air in the compressed air chamber, at least a part of the plurality of cooling holes being formed in the projection region, wherein each projection is provided with a parallel wall portion extending from the vertical wall portion to a downstream side with respect to the flow direction of the compressed air flowing in the compressed air chamber in parallel with the liner outer surface, and an inclined wall portion extending from a downstream end of the parallel wall portion to the liner outer surface in an inclined direction with respect to the flow direction of the compressed air flowing in the compressed air chamber, wherein each cooling hole is inclined so as to approach the liner outer surface toward the downstream side with respect to the flow direction of the compressed air flowing in the compressed air chamber, the end of each cooling hole on the side of the compressed air chamber opens at the inclined wall portion, and the end of each cooling hole on the side of the combustion chamber reaches more upstream than the vertical wall portion with respect to the flow direction of the compressed air flowing in the compressed air chamber, wherein each cooling hole follows a linear path from the end of the cooling hole on the side of the compressed air chamber to the end of the cooling hole on the side of the combustion chamber.

2. The combustor according to claim 1, wherein each projection is formed as a ridge extending in a direction substantially orthogonal to the flow direction of the compressed air flowing in the compressed air chamber.

3. The combustor according to claim 1, wherein each cooling hole extends in a direction substantially perpendicular to a surface of the inclined wall portion.

4. The combustor according to claim 1, wherein each cooling hole is formed so that an extension line thereof does not interfere with a projection adjacent on the downstream side with respect to the flow direction of the compressed air flowing in the compressed air chamber.

5. The combustor according to claim 1, wherein at least one of the projections is provided with a notch corresponding to an extension line of a cooling hole immediately upstream of the at least one projection with respect to the flow direction of the compressed air flowing in the compressed air chamber.

6. The combustor according to claim 1, wherein the plurality of cooling holes is arranged so as to align in a circumferential direction of the liner.

7. The combustor according to claim 6, wherein the plurality of cooling holes is arranged so as to correspond to the plurality of projections.

8. The combustor according to claim 1, wherein the plurality of projections is provided at a predetermined interval with respect to the flow direction of the compressed air flowing in the compressed air chamber, and the end of each cooling hole on the side of the combustion chamber terminates downstream, with respect to the flow direction of the compressed air flowing in the compressed air chamber, of the inclined wall portion of an adjacent upstream projection with respect to the flow direction of the compressed air flowing in the compressed air chamber.

* * * * *